United States Patent [19]

Schmidt

[11] Patent Number: 4,989,421

[45] Date of Patent: Feb. 5, 1991

[54] PROCESS FOR PRODUCING A PATTERNED PLUSH FABRIC AS WELL AS A MULTISYSTEM CIRCULAR KNITTING MACHINE FOR CARRYING OUT THE PROCESS

[76] Inventor: Walter R. Schmidt, Gerengasse 37/10, A-3500 Krems, Austria

[21] Appl. No.: 208,500

[22] Filed: Jun. 20, 1988

[30] Foreign Application Priority Data

Jun. 19, 1987 [AT] Austria ..... 1558/87

[51] Int. Cl.[5] ..... D04B 9/12; D04B 15/06

[52] U.S. Cl. ..... 66/9 R; 66/93; 66/107

[58] Field of Search ..... 66/9 R, 12, 93, 108 R, 66/108 A, 107

[56] References Cited

U.S. PATENT DOCUMENTS

| | | | |
|---|---|---|---|
| 2,094,180 | 9/1937 | Mishcon | 66/9 R |
| 3,406,538 | 10/1968 | Beckenstein | 66/9 R |
| 4,307,586 | 12/1981 | Schmidt | 66/108 R X |
| 4,612,784 | 9/1986 | Plath | 66/9 R |

FOREIGN PATENT DOCUMENTS

| | | | |
|---|---|---|---|
| 671333 | 1/1944 | Fed. Rep. of Germany . | |
| 1128706 | 4/1962 | Fed. Rep. of Germany | 66/107 |
| 2322384 | 11/1974 | Fed. Rep. of Germany . | |
| 293879 | 8/1928 | United Kingdom | 66/108 R |

OTHER PUBLICATIONS

Knitting Times, vol. 42, No. 34, Aug. 13, 1973, pp. 58 through 60, copy 66/12.

*Primary Examiner*—William C. Reynolds

*Attorney, Agent, or Firm*—Cushman, Darby & Cushman

[57] ABSTRACT

A method and apparatus for forming pile fabric where the pile loops are controlled during the knock-over action of the needles. The sinker ring mounted sinkers include separate pile and loop forming ledges. The base thread is fed into the throat of the sinker, and with the sinker positioned with their loop forming ledges between adjacent needle stems, the alternate raising different sets of needles to feeding positions and the subsequent retraction to a tuck on the latch position and the subsequent clearing of the pile threads from the loop forming ledges assures that in the knock-over action of the needles the pile loops remain under the control of the pile forming ledges.

2 Claims, 10 Drawing Sheets

PROCESS FOR PRODUCING A PATTERNED PLUSH FABRIC AS WELL AS A MULTISYSTEM CIRCULAR KNITTING MACHINE FOR CARRYING OUT THE PROCESS

BACKGROUND OF THE INVENTION

Several methods and types of knitting machines are known which can be used to knit courses alternatingly from one of at least two pile threads together with one base thread.

According to German Patent No. 671,333, two pile threads are successively fed to one of two alternate sets of needles, while the base thread is fed to all needles. As a result, the pile thread, which is fed first of all, will be arranged in a wave-like manner in front of and behind the needles. This will strain the pile thread in an uncontrollable manner during the knitting action. As a consequence of this tensioning, special requirements of the pile-yarns, such as requiring a high tenacity yarn, are necessary. Also, the different tension of the pile threads will effect the pile forming ability of each pile thread to form different pile lengths.

The wave-like arrangement of the first pile thread is approximately realized by an extraordinary adjustment of the feeding tubes, using needles with plating angle hooks and a constant feeding speed of the pile thread which results from the preferred stitch construction. If an individual needle selection is preformed, the feeding speed of the pile thread is extraordinarily different according to pile knitting or missing so that vibrations of the pile thread will occur and will prevent a regular feeding to the predetermined needles only. Also, each negligible deviation from the position of the needles or the feeding tubes will damage these parts and leads to additional faults in the fabric.

By a method according to FIG. 18 to 21 of U.S. Pat. No. 4,633,683 (based on German Patent No. 30 24 705) the feeding of the pile threads is improved by the presence of a larger space between the alternate needle sets. Nonetheless, undesirable straining or tensioning of the first fed pile thread still exists because of the wave-like arrangement established in the yarn due to its being positioned before and behind the needles until the thread is knitted. Similarly, the depending disadvantages of such tensioning of the pile yarn, as described before, still exist.

In U.S. Pat. No. 4,307,586 (based on the German Patent Specification No. 23 43 886) it is proposed to feed pile threads in a way that is analogous to the distribution of pile fibers on sliver knit machines. In succeeding feeders only a pile thread is fed to selected needles raised to their clearing position and which are then retracted to an intermediate (feeding) position until at the last feeder of a knitting cycle base thread is fed to all needles which are subsequently retracted to the knock over position.

The method described in this '586 patent is, however, characterized by the same disadvantages as German Patent No. 671,333 and U.S. Pat. No. 4,633,683. In these a correct arrangement of the pile threads before selected and behind undelected needles is impossible. Also, after feeding a pile thread to the raised selected needles and the retraction of these needles with their hooks to the intermediate position of all needles, the pile thread will rest on the hooks of the unselected needles and can slip uncontrollably before or behind these hooks. This result is sometimes assisted by the vibrations of the pile thread depending on its shortly changing feeding speed. Sinkers to control the arrangement of the pile threads are not provided. The wave-like arrangement of the pile threads from the feeding to the knitting action will also strain these threads uncontrollably so that breakage may occur. Contrary to the described feeding of a base thread during the production of sliver knit fabrics, the base thread for a pile or plush fabric must be fed underneath the sinker nebs.

Nowhere does the U.S. '586 patent set forth a way in which the base thread is fed underneath of the sinker nebs and it is simultaneously avoided that the previously fed pile threads will remain in place over of the nebs of the retracted sinkers, so that pile loops are drawn from the pile threads simultaneously to the knitting action of the needles.

To avoid the above referred disadvantages of these foregoing methods German Patent Specification No. 23 22 384 suggests that each pile thread be knit to stitches subsequent to the feeding. This method is practiced on a machine having a cylinder and dial, and the base thread is fed at first to all dial and cylinder needles. While the dial needles are knitting preferably longer stitches, the cylinder needles are retracted to an intermediate position, in which the base yarn is looped, but the clearing of the previously knitted stitches is prevented ("tuck on the latch"-position). In at least two subsequent steps in each case selected needles are raised to engage a pile thread and are retracted to their knock over position, knitting stitches from the base and pile thread and simultaneously drawing pile loops. Additional base thread for the stitches of the cylinder needles is robbed from the enlarged dial stitches. The advantages of this method are that the base thread is prelooped in the first feeder for subsequent knitting actions together with one of the pile threads and that the pile threads are knit to stitches in the same feeder in which they are fed.

The disadvantages of this approach is that the resulting fabric is characterized by a rib-construction, which reduces the pile density, and that the pile loops must protrude between the wales of the cylinder needles.

The method according to U.S. Pat. No. 4,612,784 (based on German Patent No. 31 45 307) will transfer the fundamental steps of the German Patent Specification No. 23 22 384, under consideration of U.S. Pat. No. 3,406,538, in which also all threads knitted to a course are pre-looped and which is an improvement of U.S. Pat. No. 2,094,180 in which part of threads knitted to a course are pre-looped, to a multifeed circular knitting machine with cylinder and sinker ring.

Analogous to the foregoing referred specifications the base thread and at least two pile threads are fed and prelooped in succeeding feeders by retracting the needles to the "tuck on the latch" position. All needles are raised for clearing and after feeding the base thread the needles are retracted, prelooping the base thread over the ledges of the loop sinking plates. In subsequent feeders selected needles are raised for engaging a pile thread, without clearing the loops of the base thread from the latches, and are then retracted again to the "tuck on the latch" position, prelooping the pile threads over the ledges of the knock-over plates which are also operating as holding down sinkers for the loops of the base thread. Subsequent to the feeding and pre-looping of the pile threads both sinkers ("plates") are actuated outwardly to clear the loops of the base and the pile threads from the ledges, and the knock over action of the needle is completed.

The advantages of this method are the reliable feeding of all threads with controllable tension and the prelooping of all threads immediately following the feeding. The disadvantages are the great extent of a knitting cycle based on the prelooping actions of all threads which reduces the production capacity and the necessarily coordinated adjustment of the prelooping cams to the stitch cam.

The pre-looping of the ground thread is indispensible in this concept since it is only through the higher position of the loops of the base thread that, without clearing the base thread from the latches, the needles may be raised sufficiently to have the pile thread fed into their hooks. Therefore, extended raising and retracting movements of the needles are stipulated and a reduced number of feeders will result.

A further fundamental disadvantage of this method is that the pre-looped loops of the base and pile threads must be cleared from the corresponding sinker ledges during knitting by retracting the sinkers with their nebs in front of the needles, and, for that reason, the formation of the pile loops cannot be controlled in this decisive and critical moment. Immediately after the knock-over action of the needles, the pile loops are engaged by the sinker nebs of the sinking plates and post-tensioned to obtain a satisfactory uniformity of the pile loops while the needles remain in idle position. This process, however, necessitates a certain minimum length of the pile loops and, therefore, excludes the production of short pile loops.

During knock-over it is also possible that pile loops which are directly connected with the feeder by floats can be deformed or distorted by irregular tensioning of the pile threads.

SUMMARY OF THE INVENTION

It is the object of the invention to produce a fabric as referred to in U.S. Pat. No. 4,307,586 by an improved method in which the pile loops are controlled during the knock-over action of the needles and the space of a knitting cycle is reduced which will thereby increase the production rate of a knitting machine.

The solution is achieved by feeding and positioning the base thread (without prelooping) in a usual way underneath the nebs of the retracted sinkers by controlling the movement of the base thread to the knock-over action in the throats of the sinkers which are subsequently positioned with their looping ledges between the needle stems, actuation in at least two succeeding, of steps, of alternatively predetermined needles to an upper position. These needles are retracted after they have engaged, exclusively; a pile thread to the "tuck on the latch" position and clearing the pile threads from the looping ledges prior to the knock over action. The pile loops are controlled or reformed from the pile forming ledges of the sinkers. If the pile thread were guided in the sinker throats, so as to be able to knit in a conventional and well established manner without the necessity of fine adjustment between prelooping and looping (knitting) and without the increased extent of the knitting cycle in view of pre-looping, the needle could only be raised until such a level in which the tip of the opened latch is not raised above the knitting ledge of the sinker. In this position the tips of the needle hooks are spaced only slightly above the looping ledges of the sinkers so that the pile threads must be positively located in the needle hooks by feeding sinkers.

In a multifeed circular knitting machine according to the present invention, the needles are individually controllable by one of two butts of combined pattern jacks which can be actuated by a conventional pattern device so that they will be operable with predetermined movements by associated cams. Cooperating with the needles are a plurality of pile sinkers each having loop forming ledges, holding or pile forming ledges and knitting ledges. All of these ledges are preferably formed as a part of a unitary sinker. The sinkers can be comprised of two independently movable sinkers, pile and feeding sinkers, respectively, that are controlled by associated cams. The second or feeding sinker has a feeding ledge and in its relative movement to the pile sinker serves to push a fed pile thread into a needle hook raised over or above the loop forming ledge of the pile sinker. The loop forming ledges serve to form loops in a pile thread substantially instantaneously after the pile thread is fed to the needles. Preferably a straining ledge is positioned on the pile sinker between the looping and pile forming ledges.

The advantages of the invention are achieved by the pile forming action of the last fed pile thread simultaneously to the knock-over action so that a prelooping of the base thread and one pile thread is avoided. The control of the pile loops by the pile forming ledges of the sinkers simultaneously to the knock-over action of the needles assures an equal pile forming process and also allows the production of short pile loops. By the short space of the two feeding positions one to the other the necessary movements of the needles are reduced and, therefore, the number of knitting cycles will be increased.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various Figures.

BRIEF DESCRIPTION OF THE DRAWINGS

The invention will now further be explained with reference to the drawings which are as follows.

DETAILED DESCRIPTION OF THE PREFERRED EMBODIMENT

Figure 1:
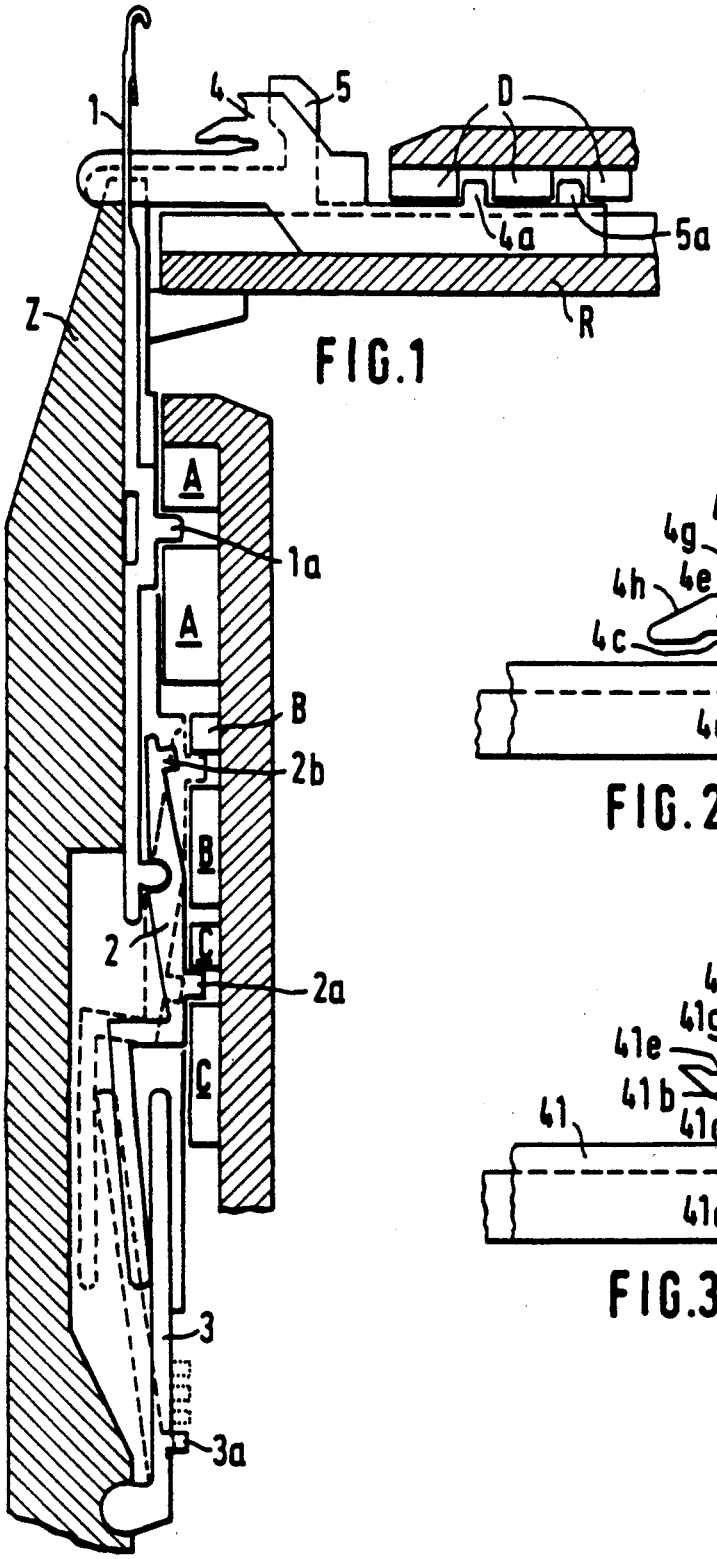
FIG. 1 is a schematic partial cross-sectional view of a circular knitting machine according to the invention.

Turning first to FIG. 1, the main construction of a multifeed circular knitting machine according to the invention is illustrated in a cross-sectional view of part of the needle cylinder and the sinker ring. Needles 1 are arranged in cuts formed in the cylinder Z. For collective movements the needles will be actuated via butts 1*a* by cams A. The jacks 2 are pivotally combined with needles 1 and are turnable or pivotable, by selectors 3, between a base position, depicted in full lines, and a selected position which is in turn depicted in dashed lines. The selectors 3 are actuated by one of the usual pattern devices which, for example, cooperate with different arranged butts 3*a*. If a jack 2 remains in its base position that jack and the cooperating needle will be actuated by butt 2*a* via cams C while butt 2*b* is withdrawn into the cylinder Z. When jack 2 is pivoted into its selected position by the operation of a selector 3, butt 2*b* will then project from the cylinder Z and will be in a position where it and the corresponding needle will be actuatable by cams B. Butt 2*a* would then be withdrawn into the cylinder Z.

Movements of the needles and jacks by one of the butts 2*a* and 2*b*, respectively, are independent one to the other and may be executed reciprocally.

The pile sinkers 4 and the feeding sinkers 5 are arranged side by side in the slots of a sinker ring R and are actuated coherently by cams D of the sinker cam arrangement on butt 4*a* or 5*a*.

Figure 2:
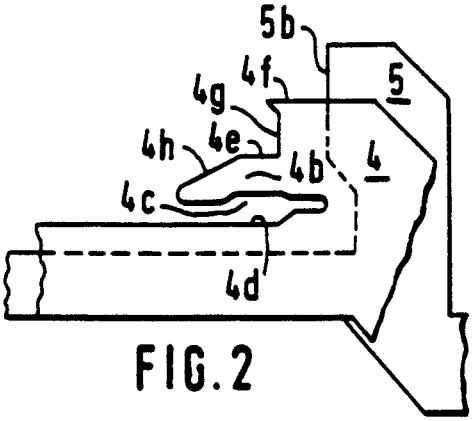
FIGS. 2 and 3 are side views of two alternatively formed pile sinkers.
Figure 3:
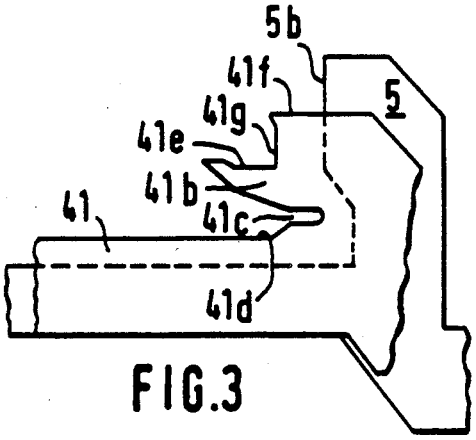

The pile sinkers 4 may be alternatively shaped, either as shown in FIG. 2 or FIG. 3.

FIG. 2 shows a pile sinker 4 with a knitting ledge 4*d*, for knitting the base thread, and a pile forming ledge 4*e* on the upper part of the sinker neb 4*b*.

In front of the pile ledge 4*e* an inclined part 4*h* is arranged on the sinker neb 4*b*, so that the tip of the neb is near the throat 4*c*. Further, the pile sinker 4 has a looping ledge 4*f* and a vertical straining ledge 4*g*.

The alternative pile sinker 41 of FIG. 3 shows a diverging shape for the sinker neb 41*b*. The tip of neb 41*b* is arranged so as to slope toward the pile forming ledge 41*e*. The knitting ledge 41*d*, the looping ledge 41*f* and the vertical straining ledge 41*g* are equivalent to the same ledges of the pile sinker 4 shown in FIG. 2.

Each of the alternative pile sinkers, 4 or 41, can be employed in any of the embodiments even if a particular embodiment shows the other as the preferred alternative. The advantage of sinker 41 is that it provides a shorter pile forming ledge and, consequently, a shorter way for retraction to clear the knitted pile loops from the sinker nebs. This further reduces the knitting cycle.

In each slot of the sinker ring R a pile sinker 4 or 41 is preferably arranged side by side with a feeding sinker 5, having a feeding ledge 5*b*. As shown in FIG. 1 pile sinkers 4 are being used.

Figure 4:
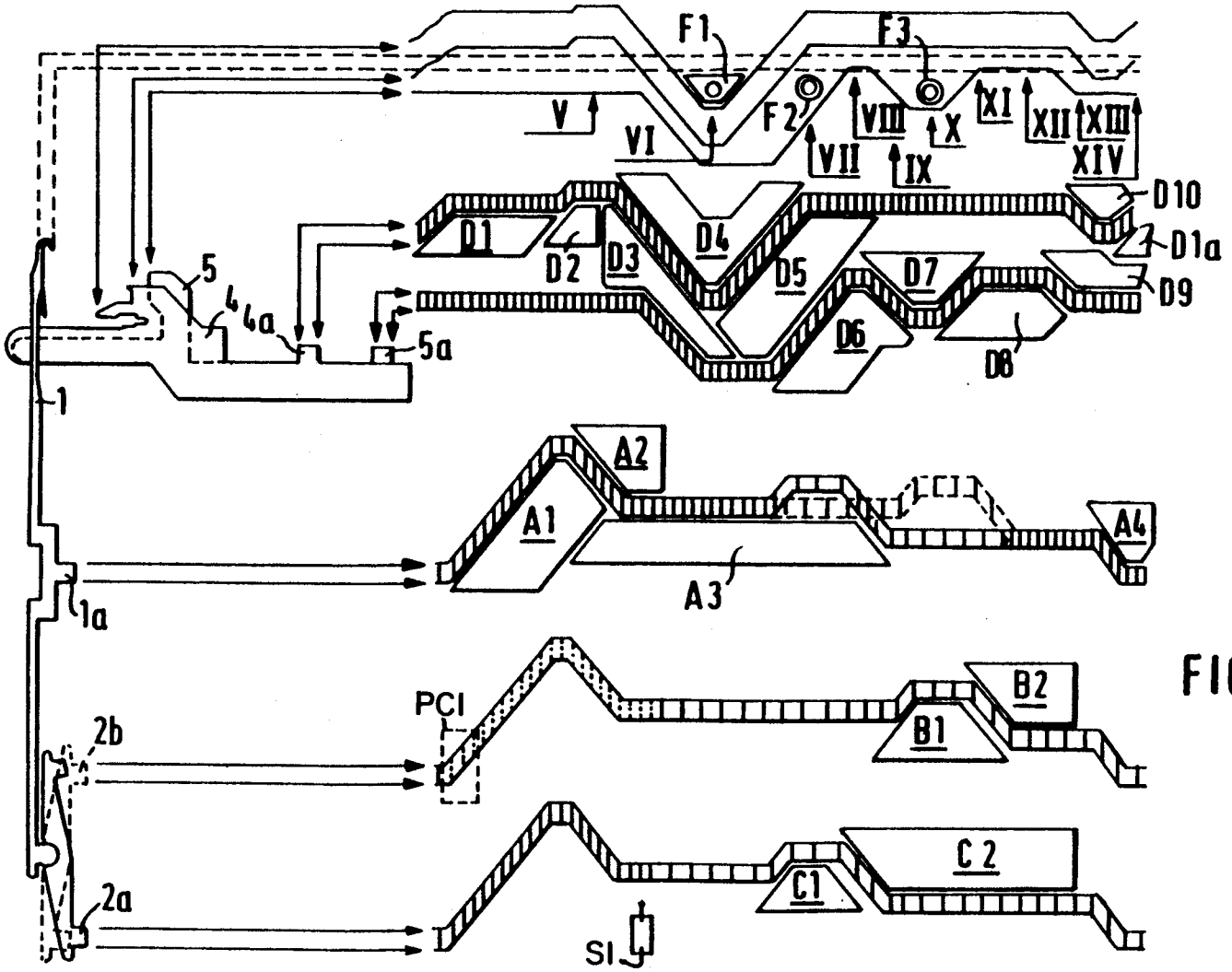
FIG. 4 and 15 are alternate control diagrams and cam sections corresponding to a first embodiment.
Figure 5:
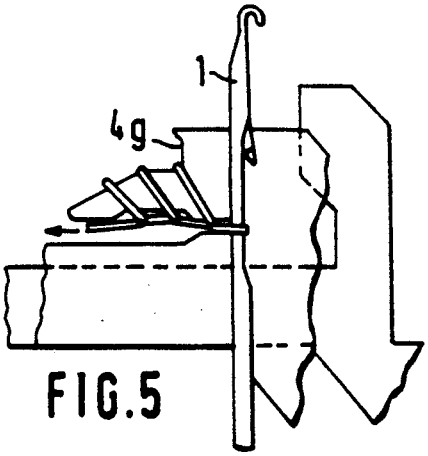
FIGS. 5 to 14 are side view sketches of the knitting elements respectively corresponding to the positions V to XIV in FIGS. 4 and 15.

With reference to the first embodiment shown in FIG. 4, sinkers 4 are used. The knitting cycle starts by raising all needles 1, via cam A1, to the clearing position. The pile sinkers 4 are controlled by cam D1. The presser cam PC1 will move all butts 2*b* of the jacks 2 into the cylinder Z thereby placing all jacks 2 and selectors 3 into their base positions. As soon as the previously knitted stitches are cleared from the latches, the pile sinkers 4 are actuated inwardly by cam D2, so that the previously knitted pile loops are strained by ledges 4*g* and the corresponding needle stitches of the pile threads are tightened to the needle stems. This is performed in position V of FIG. 4 and shown in FIG. 5.

Figure 6:
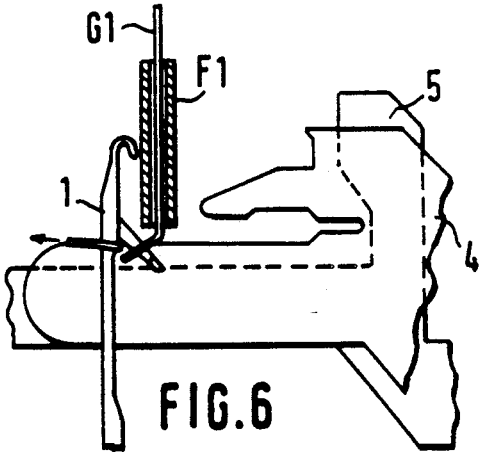

Simultaneously, needles 1 are retracted by cam A2 to a lower feeding position and the pile sinkers 4 and the feeding sinkers 5 are actuated with their nebs positioned outwardly of the needle stems by cam D3 or D4, respectively, so that at position VI of FIG. 4 the feeding of the base thread occurs as shown in FIG. 6.

As is additionally shown in FIG. 6, the base thread G1 is fed by feeder F1 underneath of the nebs 4*b* of the pile sinkers 4 to the needles 1. Immediately after feeding the base thread G1 the pile sinkers 4 are actuated inwardly by cam D5 so that the base thread is controlled from within the throat 4*c*. Simultaneously, the nebs 4*b* will penetrate the previously knitted pile loops which will slide on the inclined part 4*h*upward onto the pile forming ledge 4*e* as in FIG. 7. The inward movement of the pile sinkers 4 will position the looping ledges 4*f* between the needle stems of needles 1. In a coordinated fashion with the inward movement of the pile sinkers a conventional pattern device S1 will actuate certain predetermined selectors 3, which in turn will move the corresponding jacks 2 into their selected position. The cooperating needles 1 of the remaining non-selected jacks 2 are then raised to an upper feeding position via butts 2*a* by cam C1 so that at VII of FIG. 4, as shown in FIG. 7, a first pile thread P1 can be fed to those raised needles.

Figure 7:
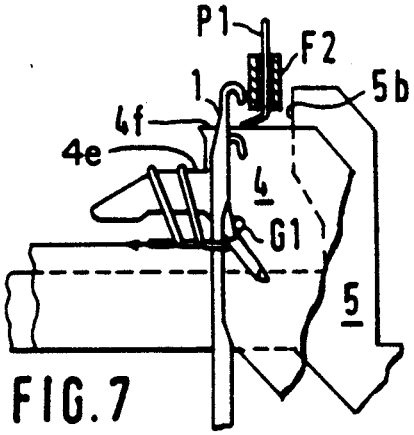
Figure 8:
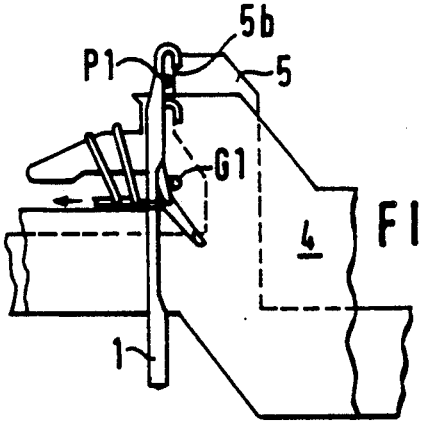

As shown in FIG. 7 the looping ledges 4*f* of pile sinkers 4 will cover the needle hooks of those needles 1 remaining still in a lower feeding position, while the needle hooks of the selected needles will project over or above the looping ledges 4*f*. Feeder F2 will feed the first pile thread P1 exclusively to the raised needles which are in the upper feeding position. At this same time the feeding sinkers 5 start a coordinated inward movement actuated by cam D6. This action is performed at VIII of FIG. 4, as shown in FIG. 8. This will assure the pile thread P1 is definitely inserted into the needle hooks by feeding ledge 5*b* of the feeding sinkers 5.

Figure 9:
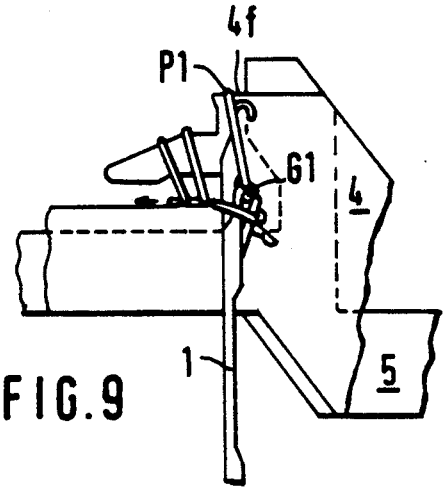

Immediately with the insertion of the pile thread P1, cam C2 will retract the selected needles, via butts 2*a* of the cooperating jacks 2 ,from the upper feeding position to the "tuck on the latch" position, shown at position IX and in FIG. 9. This will draw the pile thread P1 to predetermined loops over the looping ledges 4*f* without clearing the previously knitted stitches from the needles.

Figure 10:
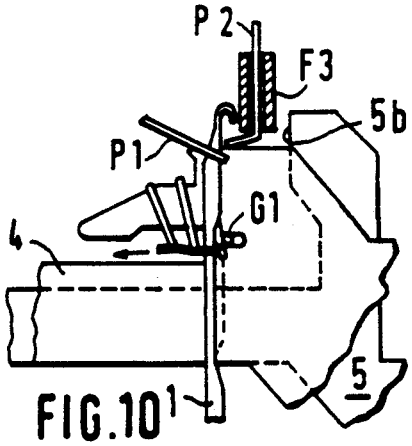

As visible in FIG. 9 the base thread G1 will further move in the throat of the sinkers and in the hooks of the retracted needles without handicapping the succeeding knock-over action, while the pile thread P1 after looping has no relative movement to the needles and sinkers. Simultaneously with the looping of the pile thread P1 the feeding sinkers 5 are actuated outwardly by cam D7. Subsequent to the looping action of the pile thread P1, the turned or selected jacks 2 and the cooperating needles 1 are raised via butts 2*b* by cam B1 from the lower to the upper feeding position. At position X of FIG. 4, and with reference to FIG. 10, the feeding sinkers 5 are actuated outwardly by cam D7 so far that feeder F3 can feed a second pile thread P2 to the newly raised or selected needles which now project over or above the looping ledges 4*f*. The feeding sinkers 5 are subsequently actuated inwardly by cam D8, inserting the pile thread P2 into the needle hooks at position XI in FIG. 4, as exhibited in FIG. 11.

Figure 12:
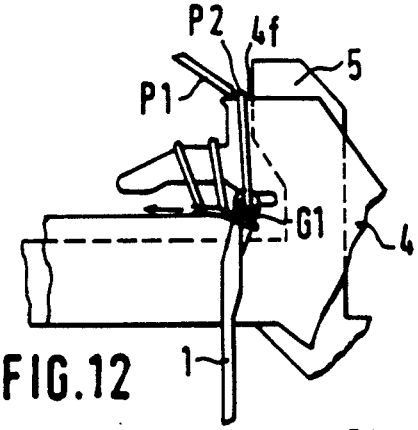
Figure 13:
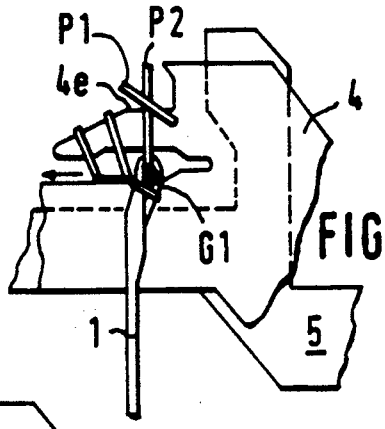

Thereafter the raised needles 1 are retracted from the cooperating jacks 2 via butts 2b by cam B2 to the "tuck on the latch" position, forming alternatively loops from pile threads P2 over the looping ledges 4f at position XII of FIG. 4, as shown in FIG. 12. The pile thread P1 will miss the looping ledge 4f when pile thread P2 is looped and vice versa. Immediately after looping the pile thread P2 the pile sinkers 4 and the feeding sinkers 5 are actuated outwardly by cams D9 and D10, respectively, to clear the pile loops and floats from the looping ledges 4f as detailed at position XIII of FIG. 4, and shown in FIG. 13.

Figure 14:
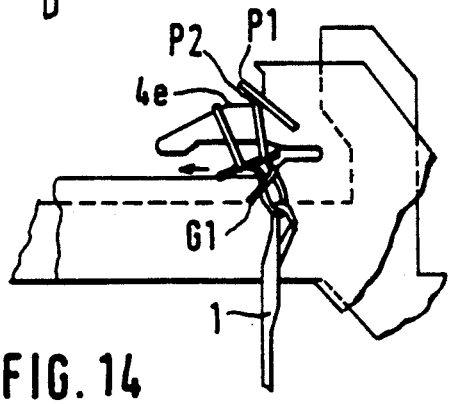

Subsequently all needles are retracted to the knock-over position and the sinkers 4 start with their holding down action by cam D1*a* of the succeeding knitting cycle. Therefore at position XIV of FIG. 4, see FIG. 14, a complete course is knitted from the base thread G1 and one or the other of the pile threads P1 or P2, alternatively, thereby forming pile loops and floats, respectively.

At the knock-over action of the needles the pile loops rest on the pile forming ledges 4e. Any unverifiable deformation of the pile loops is avoided. If pile loops according to the needle selection are directly connected with the feeder a deformation is also avoided by the postforming action over the pile forming ledges 4e of the sinkers. Therefore, it is possible that the pile loops of the last fed pile thread are formed simultaneously with the knitting action of the needles and the previous pre-looping process is avoided.

Figure 15:
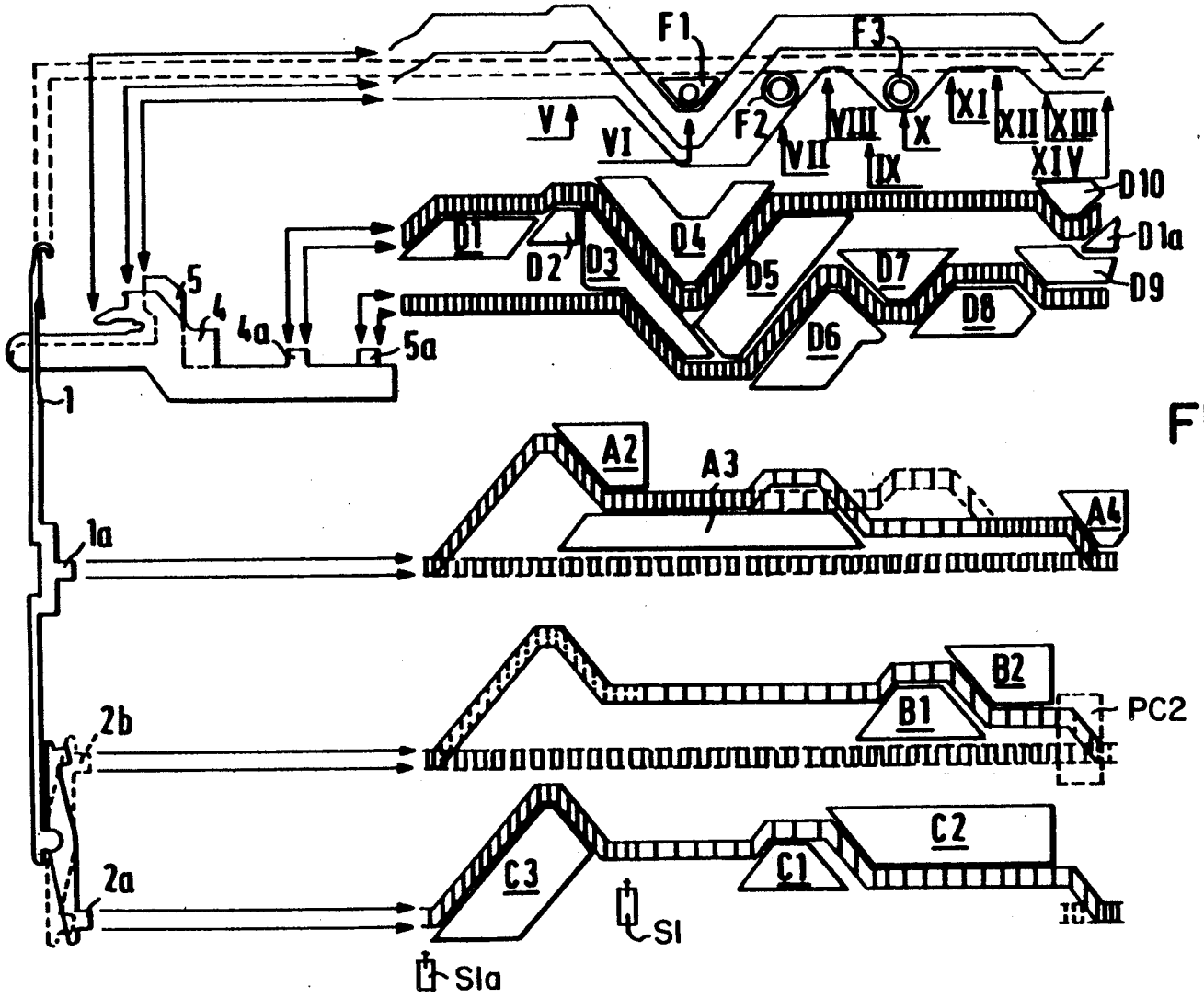

In FIG. 15 a modification of FIG. 4 is shown in which two pile threads are also alternatively knit with a base thread, but divergent to FIG. 4 from predetermined needles. The additional presser cam PC2 will move all butts 2b into the cylinder Z simultaneously to the knock-over action of the needles. Therefore, a selection is realized by an additional selecting device S1*a* prior to the raising of the predetermined needles. Jacks 2 remaining in base position and the cooperating needles are raised on butts 2a by cam C3 to the clearing position. Other needles will be cooperating with the turned or selected jacks 2. After retraction of the raised needles by cam A2, the cooperating selecting jacks 2 are subdivided by a pattern device S1 and a part of the butts 2b previously withdrawn in cylinder Z, will project into cam 3 for further control. The subsequent movements of the needles and sinkers 4 and 5 are identical as described previously in accordance with FIGS. 4 to 14.

A second embodiment using pile sinkers 41 (FIG. 3) is shown in FIGS. 16 to 22. Because of the reduced length of the sinker nebs 41b, as opposed to the nebs 4b of sinkers 4, the extent of the sinker movement is reduced.

Figure 16:
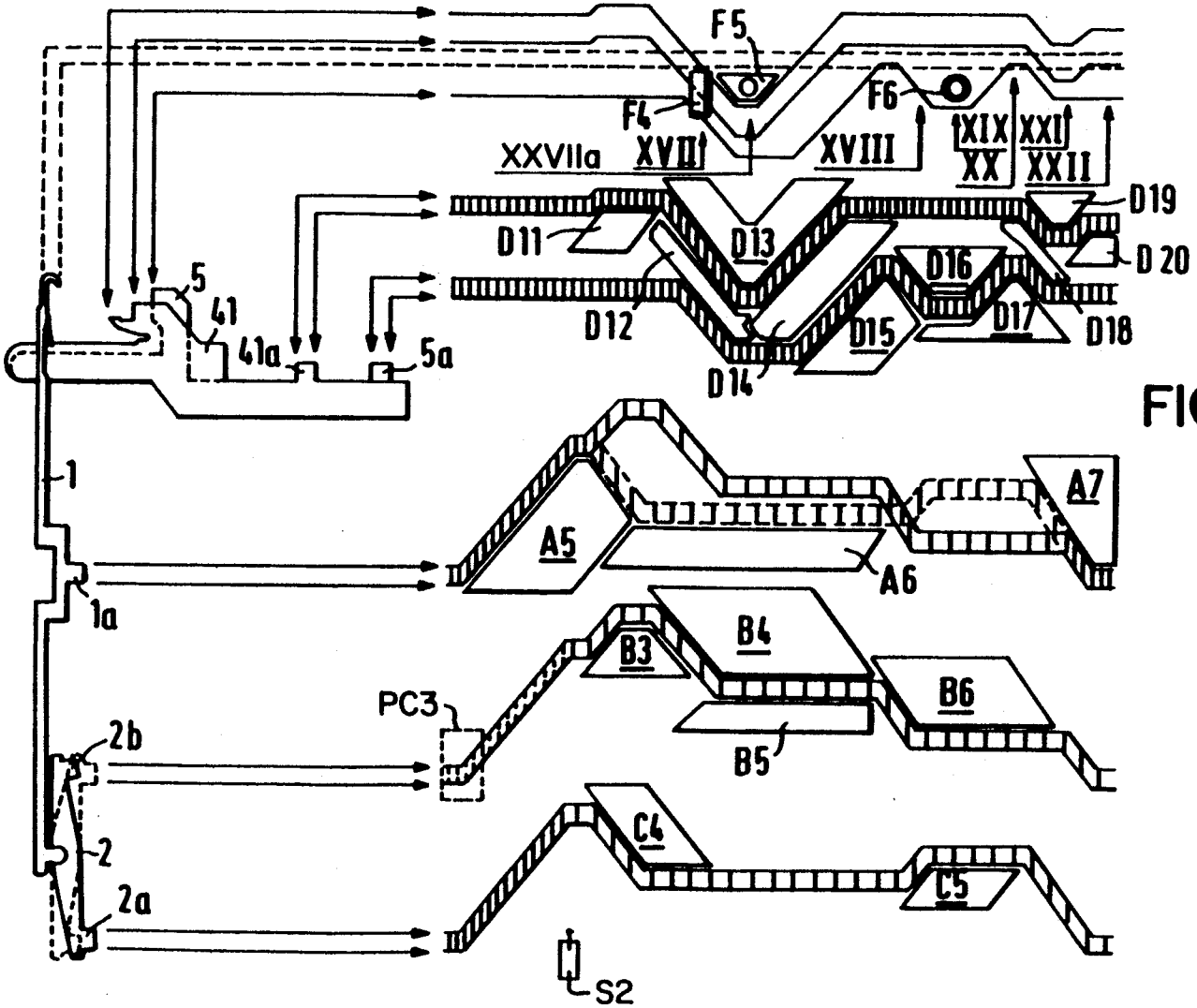
FIG. 16 is a control diagram and cam section corresponding to a second embodiment.

According to FIG. 16 all needles are raised from cam A5 to clearing. Simultaneously presser cam PC3 moves all butts 2b into the cylinder, so that subsequently predetermined jacks 2 are pivotable into the selected position by pattern device S2. When the latches are cleared from the previously knitted stitches cam D11 actuates the pile sinkers 4 inwardly, so that ledges 41g will strain the pile loops. Cam B3 acting on butts 2b of selected jacks 2 will additionally raise their cooperating needles (a first set) while cam C4 will retract via butts 2a, the remaining jacks with cooperating needle (a second set) to a lower feeding position, so that at position XVII of FIG. 16 a first pile thread can be fed.

Figure 17A:
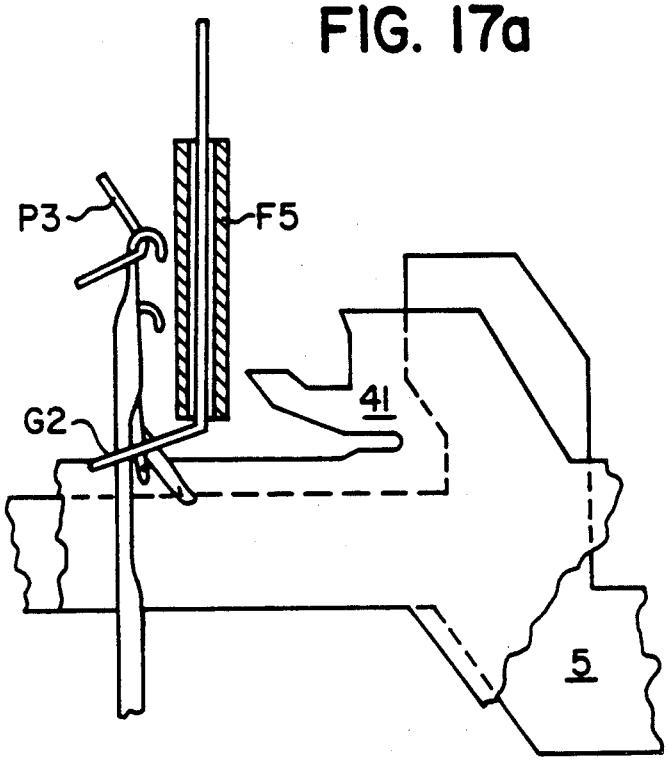
FIGS. 17 to 22 are side view sketches of the knitting elements respectively corresponding to the positions XVII to XXII in FIG. 16.
Figure 17:
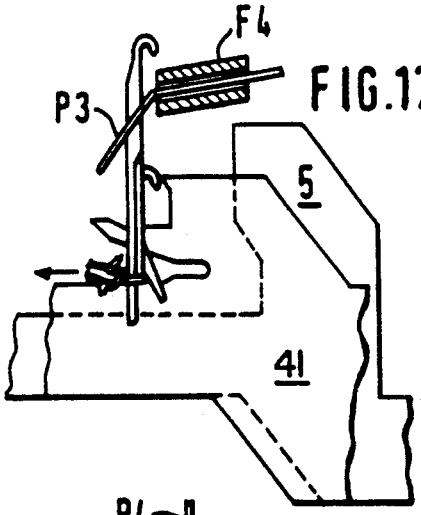

As is visible from FIG. 17, the pile thread P3 is directly fed from feeder F4 to the additional raised needles. The space between the divided needles is sufficient for feeding pile thread P3 into the needle hooks by feeder F4.

Simultaneously the pile sinkers 41 and the feeding sinkers 5 are moved outwardly by cams D12 or D13. While the second set of needles remain in the lower feeding position cam B4 will cause the retraction of the selected first set of needles to an upper feeding position in which feeder F5 will feed a base thread G2 to all raised needles, as shown in FIG. 17*a*, thus including the needles at both upper and lower feeding positions. When the base thread G2 is fed, the pile sinkers 41 are immediately actuated inwardly by cam D14 until the looping ledges 41f are moved underneath of the pile thread P3 in position between the needle stems.

Figure 18:
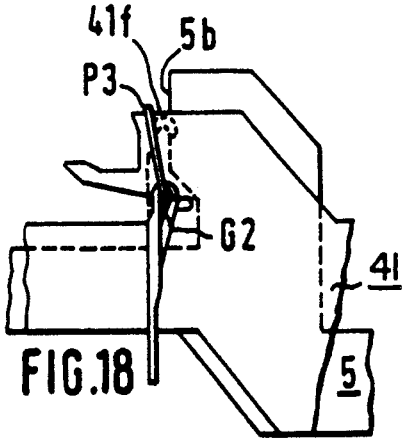

Subsequently the first set of needles needles controlled in the upper feeding position are retracted via butts 2b of the jacks 2 by cam B6 to the "tuck on the latch" position at location XVIII of FIG. 16. By the simultaneous inward movement of feeding sinkers action by cam D15 the insertion of the pile thread is ensured. As shown in FIG. 18 the pile thread P3 is pre-looped over the looping ledges 41f, while the base thread G2 is further controlled in the throats without any effort to the knitting action.

The feeding sinkers 5 are then actuated outwardly by cam D16, while cam C5 will raise the remaining needles second set of from the lower to an upper feeding position. It should be understood that feeding sinkers 5 need not necessarily be actuated outwardly or retracted. They could already be positioned outwardly or in a retracted position. The inward and subsequent outward movement have been shown for clarity and may be avoided in practice to avoid unnecessary movements. It is actually preferred to omit the inward movement of the feeding sinkers to allow earlier feeding of the second pile thread and further reduce the extent of the knitting cycle.

Figure 19:
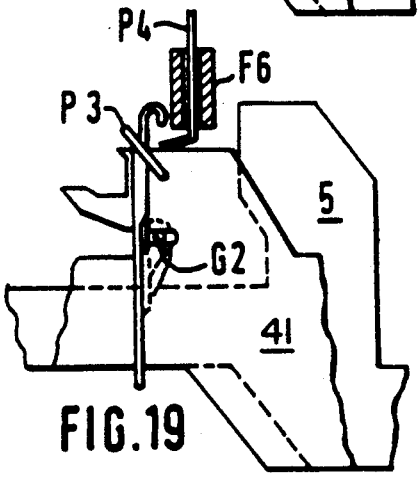
Figure 20:
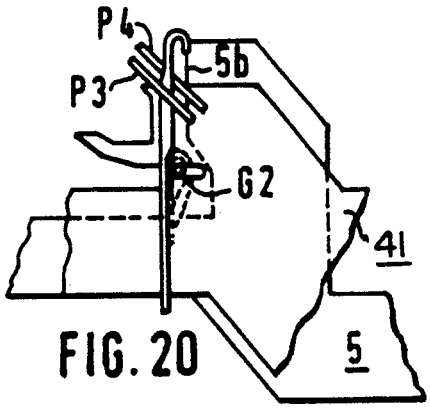
Figure 21:
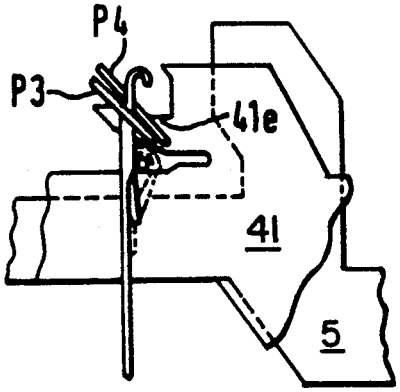

At position XIX of FIG. 16 a second pile thread is fed exclusively to these needles (the second set) F6. As shown in FIG. 19 feeder F6 will position the pile thread P4 in front of the opened needle hooks. Immediately thereafter, the feeding sinkers 5 are actuated inwardly by cam D17, inserting the pile thread P4 into the needle hooks at position XX of FIG. 16 and as shown in FIG. 20. When the needles of the second set start to retract on cam A7, simultaneously cam D18 and D19 will actuate the pile sinkers 41 and feeding sinkers 5 outward, clearing the pile threads P3 and P4 from the looping ledges 41f at XXI of FIG. 21. As shown in FIG. 16 the last fed pile thread P4 remains unlooped from the looping ledges of the sinkers.

The pile sinkers 41 are subsequently actuated inwardly by cam D20 while the needles are being retracted into their knock-over position by cam A7 as described at position XXII of FIG. 16.

Figure 22:
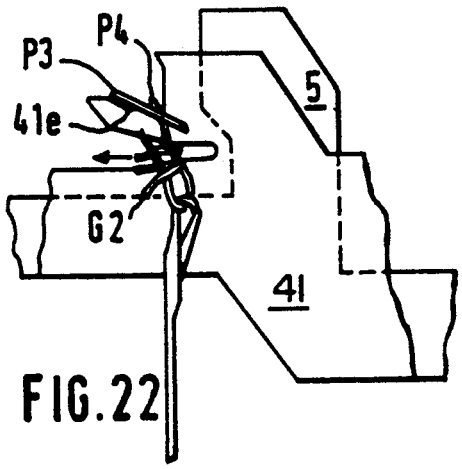

Simultaneously with the knitting action all needles which had engaged pile thread P4 will draw pile loops over the pile forming ledges 41e directly, as shown in FIG. 22.

Floats of the pile thread P4 will rest on the pile ledge 41e of the sinker nebs which are holding pile loops of pile thread P3 in place.

It is obvious from the description of the foregoing embodiment that the width of a knitting cycle is reduced and their number can be increased, if the last fed pile thread is looped simultaneously with the knitting action.

Figure 23:
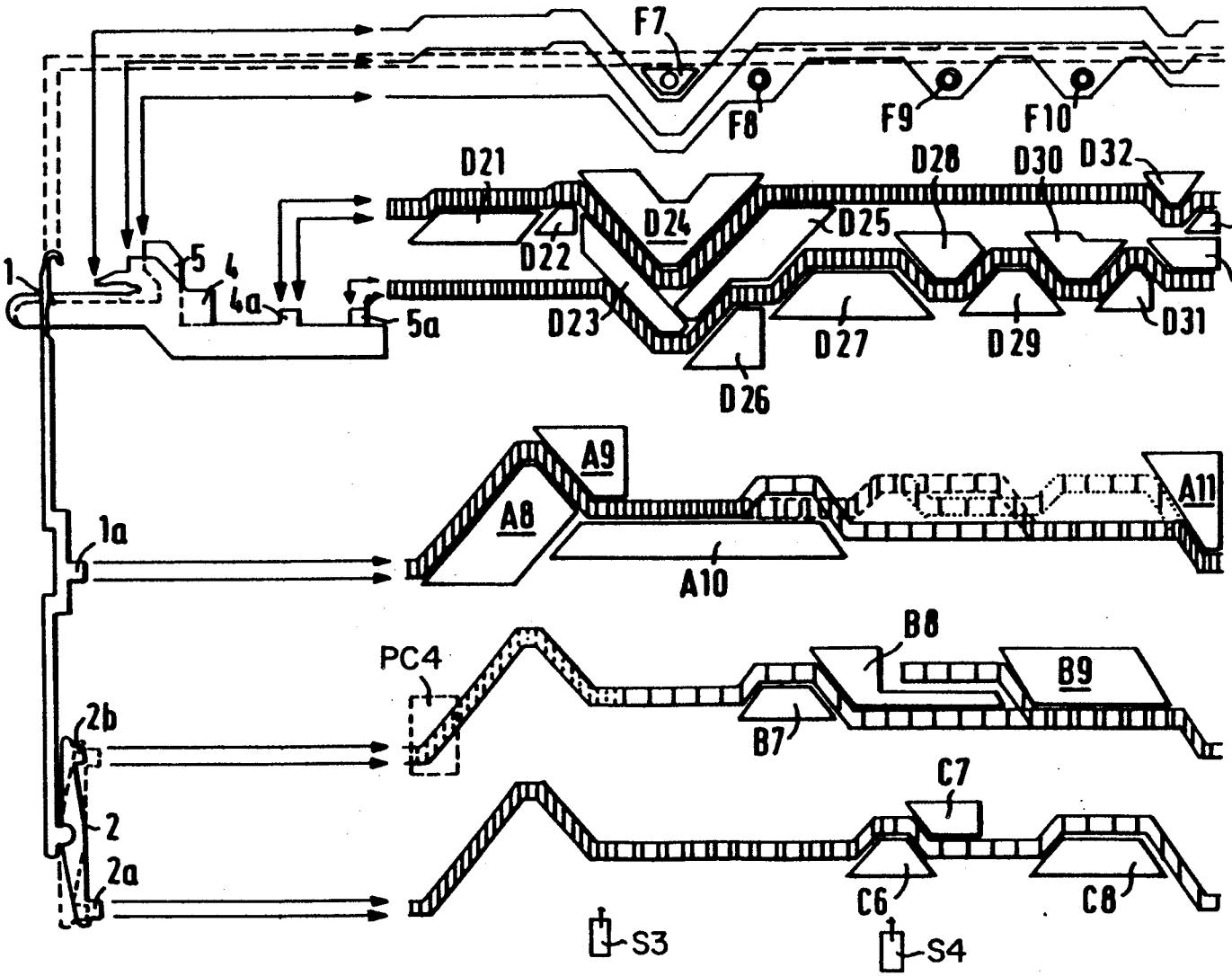
FIG. 23 is a control diagram and cam section corresponding to a third embodiment.

In FIG. 23 an embodiment is shown in which three pile threads are alternatively knitted together with a base thread. It is realized principally as referred in the embodiments before. All needles 1 are raised for clearing by cam A8 and retracted by cam A9 to the feeding position. Simultaneously, the previously knitted pile loops are strained from straining ledges 4g by a movement actuated from cam D22 (analogous to FIG. 5). After actuating all sinkers outwardly by cam D23 and D24 the feeding of a base thread by feeder F7 is executed (analogous to feeder F1 at FIG. 6). Simultaneously a selection of the jacks 2 by pattern device S3 is performed which previously were positioned in base position by presser cam PC4. Selected jacks 2 and their cooperating needles are raised to an upper feeding position by cam B7 acting on butts 2b and subsequent to the movement of the pile sinkers 4 with their looping ledges 4f between the needle stems by cam D25, feeder F8 will feed a first pile thread to the selected needles (analogous to FIG. 7). By cams D26 and D27 the feed sinkers 5 will insert the pile thread with their feeding ledges 5b into the needle hooks (analogous to FIG. 8) whereupon the selected needles are retracted by cam B8 to the "tuck on the latch" position (analogous to FIG. 9).

Subsequently all needles remaining in the lower feeding position are raised by cam C6 to the upper feeding position in which the jacks 2 of these needles are divided by a pattern mechanism S4. Non-actuated jacks 2 remaining in their base position and the cooperating needles are retracted to the lower feeding position again by cam C7. Butts 2b of jacks 2 will protrude after passing cam B8 from the cylinder. As the feeding sinkers 5 are actuated by cam D28 outwardly, a second pile thread is fed by feeder F9 (analogous to FIG. 10). The second pile thread is thereupon inserted by feeding ledges 5b of the feeding sinkers which are actuated inwardly by cam D29 (analogous to FIG. 11) and subsequently these needles are retracted from the upper feeding position to the "tuck on the latch" position by cam B9 (analogous to FIG. 12). The feeding sinkers 5 are again actuated outwardly by cam D30. Those needles previously lowered by cam C7 and which had not engaged a pile thread in the prior actions are raised by cam C8 to the upper feeding position.

Figure 11:
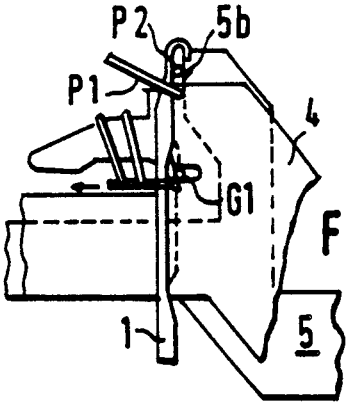

A third pile thread is fed to these needles by feeder F10 (analogous to FIG. 10) which is inserted into the needle hooks by the feeding ledges 5b of the feeding sinkers 5 which are again actuated inwardly by cam D31 (analogous to FIG. 11). As the needles start to retract on stitch cam A11 all the cams D32 and D33 actuate the pile sinkers 4 and the feeding sinkers 5 outwardly for clearing all pile threads from the looping ledges 4f.

Simultaneously with the retraction of the needles, cam D34 will position the pile sinkers 4 with their pile forming ledges 4e between the needle stems and all needles are retracted to the knock over position.

During the knitting action all pile loops of the first and second pile thread are controlled by the pile forming ledges 4e for a reliable formation of the pile loops. The pile loops of the third pile thread are directly drawn over the pile forming ledges 4e simultaneously with the knitting action without any prelooping. The foregoing described action of the pile sinkers is one of the most essential advantages of the invention.

It should be noted, that in place of jacks 2, needles with additional needle butts replacing one of the butts 2a or 2b may be alternatively used to accomplish this invention.

With respect to the foregoing embodiments, the base thread G1 or G2, respectively, is fed by the base thread thread feeder F1, F5 or F7, respectively, at the level of the sinker throats 4c or 41c, respectively, and is fed at this level to the needles 1 with opened needle latches. It is, however, also easily possible in the scope of the present invention to feed the base thread G1 or G2, respectively, at a level above the sinker nebs 4b or 41b, respectively, and then to pull it downwardly by a retraction movement of needles 1 to the level of the sinker throats 4c or 41c, respectively. The space requirement for each system is indeed somewhat increased, compared to the minimum obtainable space requirement, but a simplification of the apparatus can be achieved more easily as then the needles have to be arranged in one single feeding position and in one tuck on the latch position only, so that no opposite control movements of individual needles occur; thus, a pattern device positioned below the needle butt can only produce the rise movements, whereas the needle butt controls the reraction movements. A simplified construction and apparatus for the pattern control thus results.

Figure 24:
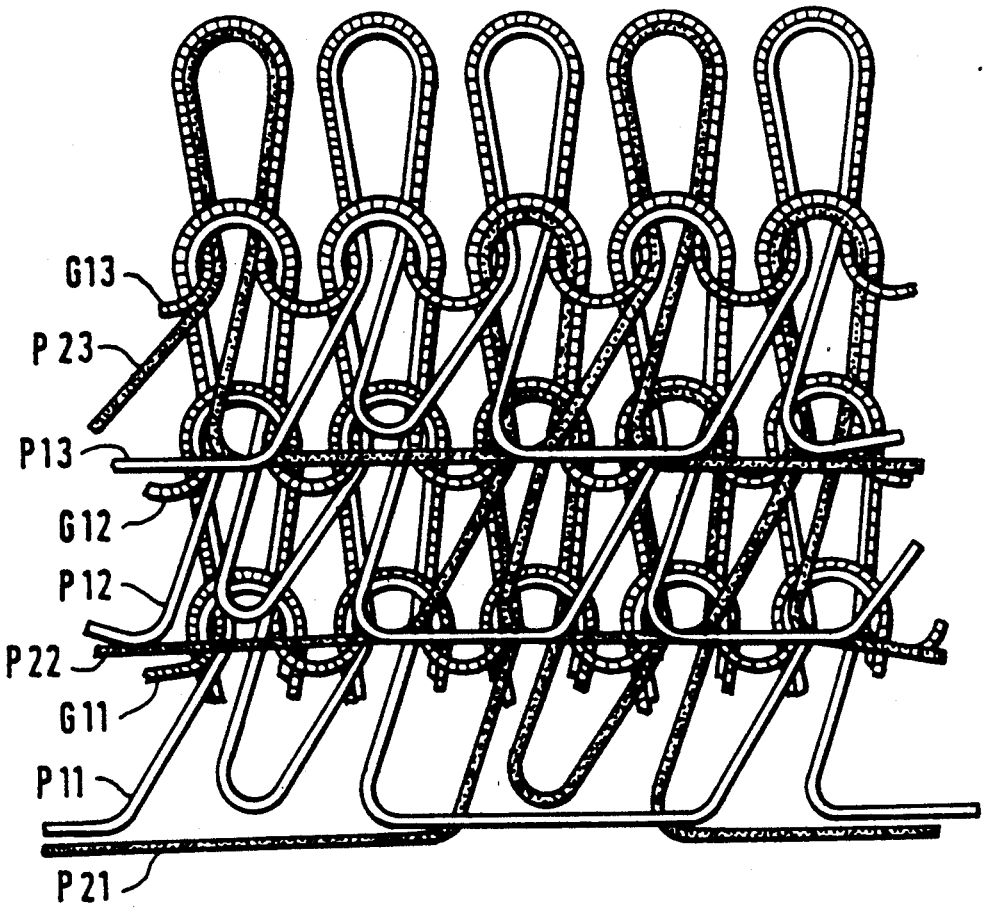
FIG. 24 shows a stitch construction of a two colored patterned pile fabric knit in accordance with the present invention.

In FIG. 24 a stitch construction of a two colored pile fabric is shown as produced by the present invention, specifically as set forth in conjunction with FIGS. 4, 16 and 23. In a first course all stitches are knit from a base thread G11 and alternatively from a first pile thread P11 and a second pile thread P21.

The predetermined non-knitting pile thread is formed as a float which projects over the pile loops of the knitting pile thread. In the same way as described before a second course is knit from a base thread P22, also a third course from a base thread G13 and a first pile thread P13 and a second pile thread P23. If a third pile thread, per course, is fed in accordance with the embodiment of FIG. 23, alternatively two of the three pile threads will spread over and cover the pile loops of the knitting and pile forming thread.

In the subsequent finishing operations the pile loops are opened by shearing. Simultaneously, the floats of the pile threads are removed and the fabric gets its final appearance.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

What is claimed is:

1. A method for producing patterned pile fabric on a multifeed circular knitting machine featuring a plurality of cylindrically mounted latch needles, controllable by selection devices, and a plurality of pile sinkers mounted in a sinker ring, the pile sinkers having sinker nebs, a pile forming ledge and a loop forming ledge, wherein at least two pile threads are fed in a predetermined sequence and knit into a stitch course together with a previously fed base thread, the method including the steps of:

(a) raising the plurality of needles into a clearing position and retracting the plurality of pile sinkers;

(b) feeding a base thread to the raised needles and positioning said base thread at the level of the sinker throats;

(c) positioning each of the pile sinkers so that the base thread enters the sinker throats and the loop forming ledge lies between adjacent needle stems;

(d) controlling the movement of the plurality of needles and positioning a first predetermined set of needles selected from among the plurality of needles at an upper position;

(e) feeding a first pile thread before the first set of needles while positioned in the upper position and positively locating said first pile thread in the needle hooks;

(f) retracting the first set of needles from the upper feeding position, after engagement of the first pile thread, to a tuck on the latch position;

(g) subsequently raising another predetermined set of needles, selected from among the plurality of needles, to an upper position;

(h) feeding another pile thread before said another set of needles while positioned in the upper position and positively locating said another pile thread in the needle hooks;

(i) retracting said another set of needles from their upper position, after engagement of said another pile thread, to a tuck on the latch position;

(j) controlling the movement of the pile sinkers so that their pile forming ledges are respectively positioned between adjacent needles; and (k) retracting the plurality of needles into the knock-over position so that the pile loops are formed over the pile forming ledges.

2. A multifeed circular knitting machine for producing patterned pile fabric comprised of a needle cylinder having a plurality of latch needles each with a needle hook and each being operatively mounted therein and a plurality of pile and feeding sinkers each being operatively associated with one of said needles and being moveable independently of each other, each pile sinker having integrally formed knitting, pile forming and loop forming ledges, said loop forming ledges serving for forming loops of a pile thread instantaneously after having been fed to said needles, characterized in that said pile forming ledge forms pile loops in the course of the knock-over movement of said needles, and wherein said feeding sinker is comprised of a feeding ledge, said feeding sinker being movable relative to said pile sinker so that a pile thread can, after feeding, be positively located in a needle hook positioned in a feeding position above said loop forming ledge.

* * * * *